United States Patent [19]

Okada et al.

[11] 4,352,057

[45] Sep. 28, 1982

[54] CONSTANT CURRENT SOURCE

[75] Inventors: Takashi Okada; Hiroshi Sahara, both of Yokohama; Fumikazu Otsuka, Tokyo, all of Japan

[73] Assignee: Sony Corporation, Tokyo, Japan

[21] Appl. No.: 276,943

[22] Filed: Jun. 24, 1981

[30] Foreign Application Priority Data

Jul. 2, 1980 [JP] Japan ..... 55/90185

[51] Int. Cl.[3] ..... G05F 3/16

[52] U.S. Cl. ..... 323/315; 307/297; 330/296

[58] Field of Search ..... 307/296 R, 297; 323/311, 312, 315, 316; 330/296, 297

[56] References Cited

U.S. PATENT DOCUMENTS

| | | | |
|---|---|---|---|
| 3,895,286 | 7/1975 | Steckler | 323/315 |
| 4,119,869 | 10/1978 | Hashimoto | 330/297 X |
| 4,177,417 | 12/1979 | Henry et al. | 323/315 |
| 4,217,539 | 8/1980 | Okada | 323/316 |
| 4,292,583 | 9/1981 | Hoeft | 323/316 |

*Primary Examiner*—A. D. Pellinen

*Attorney, Agent, or Firm*—Hill, Van Santen, Steadman, Chiara & Simpson

[57] ABSTRACT

A constant current generating circuit is provided which comprises first, second, third and fourth transistors of one conductivity type, each having base, emitter and collector electrodes, and a voltage supply source having first and second voltage terminals. In this case, the collector and emitter electrodes of the first transistor are respectively connected to the first and second voltage terminals with a first impedance between the collector electrode and first voltage terminal; the emitter electrode of the second transistor is connected to the second voltage terminal through a second impedance; the emitter electrode of the third transistor is connected to the second voltage terminal through a third impedance; the emitter electrode of the fourth transistor is connected to the second voltage terminal; the base electrode of the first transistor is connected to the emitter electrode of the second transistor; the collector electrode of the first transistor is connected commonly to the base electrodes of the second and third transistors; the emitter electrode of the third transistor is connected to the base electrode of the fourth transistor; and a current utilizing means is connected between the first voltage terminal and at least one of the collector electrodes of the second, third and fourth transistors.

1 Claim, 5 Drawing Figures

CONSTANT CURRENT SOURCE

BACKGROUND OF THE INVENTION

1. Field of the Invention

The present invention relates generally to a constant current source and is directed more particularly to a transistor constant current source.

2. Description of the Prior Art

In a prior art constant current source shown in FIGS. 1 and 2, the following equation (1) is established between a base-emitter voltage $V_{BE}$ of a transistor used therein and its emitter current $I_E$.

$$V_{BE}=(kT/q)\ln(I_E/I_s) \quad (1)$$

where k is the Boltzmann's constant;

T is the absolute temperature;

q is the charge of an electron; and $I_s$ is the saturated current in the reverse direction.

Between the saturated current $I_s$ in the reverse direction and an emitter-base junction area A of the transistor, established is the following equation (2).

$$I_s=\gamma \cdot A \quad (2)$$

where $\gamma$ is a proportional constant.

In the prior art circuit of FIG. 1, since the base-emitter voltage of a transistor $Q_1$ is equal to that of another transistor $Q_2$, the following equation (3) is established from the equations (1) and (2).

$$(I_{E1}/I_{E2})=(A_1/A_2) \quad (3)$$

where $I_{E1}$ is the emitter current of the transistor $Q_1$;

$I_{E2}$ is the emitter current of the transistor $Q_2$;

$A_1$ is the emitter-base junction area of the transistor $Q_1$; and $A_2$ is the emitter-base junction area of the transistor $Q_2$.

If the current amplification factor $h_{FE}$ of each of the transistors $Q_1$ and $Q_2$ is assumed sufficiently large, the base current thereof can be neglected. Therefore, the following relation (4) can be derived.

$$\left.\begin{aligned} I_1 &= I_{E1} \\ I_2 &= I_{E2} \end{aligned}\right\} \quad (4)$$

where $I_1$ is the collector current of the transistor $Q_1$; and $I_2$ is the collector current of the transistor $Q_2$.

From the equations (3) and (4), obtained is the following equation (5)

$$(I_2/I_1)=(A_2/A_1) \quad (5)$$

Since the following equation (6) is established on the transistor $Q_1$, $$I_1=\frac{V_{CC}-V_{BE}}{R_1} \quad (6)$$

where $V_{CC}$ is the voltage of a power source; and $R_1$ is the resistance value of a resistor $R_1$ connected to the collector of the transistor $Q_1$, the current $I_2$ can be expressed from the equations (5) and (6) as follows:

$$I_2=\frac{V_{CC}-V_{BE}}{R_1}\cdot\frac{A_2}{A_1} \quad (7)$$

Therefore, the transistor $Q_2$ serves as a constant current source of the absorption type with the current represented by the equation (7).

With the above prior art circuit, since relation or ratio between the currents $I_1$ and $I_2$ is represented by the equation (5), if the ratio $I_2/I_1$ is large, for example, the current $I_2$ is selected large as 100 times as the current $I_1$, it is necessary that the junction area $A_2$ is selected 100 times of the junction area $A_1$. Thus, the above prior circuit requires a large area and hence it is not suitable to be made as an IC (integrated circuit). While, in the case that the ratio $I_2/I_1$ is small, if the current $I_2$ is selected 1/100 of the current $I_1$, the junction area $A_1$ must be selected as large as 100 times of that $A_2$. Thus, this case is not suitable as an IC, too.

In the prior art circuit of FIG. 2, the following equation (8) is established on the base of the transistor $Q_2$.

$$I_1R_1+V_{BE1}=I_2R_3+V_{BE2} \quad (8)$$

where $V_{BE1}$ is the base-emitter voltage of the transistor $Q_1$;

$V_{BE2}$ is the base-emitter voltage of the transistor $Q_2$; and $R_3$ is the resistance value of a resistor $R_3$ connected to the emitter of the transistor $Q_2$.

Since the following equation (9) is established, the equation (10) can be obtained from the equations (8) and (9).

$$\Delta V_{BE}=V_{BE2}-V_{BE1} \quad (9)$$

$$=\frac{kT}{q}\ln\left(\frac{I_2}{I_1}\right)$$

$$\frac{I_2}{I_1}=\frac{R_2}{R_3}\left\{1-\frac{\frac{kT}{q}\ln\left(\frac{I_2}{I_1}\right)}{R_2I_1}\right\} \quad (10)$$

where $R_2$ is the resistance value of a resistor $R_2$ connected to the emitter of the transistor $Q_1$.

If the voltage drop across the resistor $R_1$ is about the base-emitter voltage $V_{BE}$, the second term in the brace of the equation (10) is small and hence neglected. Thus, the equation (10) can be considered as follows:

$$(I_2/I_1)\approx(R_2/R_3) \quad (11)$$

Accordingly, the current $I_2$ can be expressed as follows:

$$I_2=\frac{V_{CC}-V_{BE1}}{R_1+R_3}\cdot\frac{R_2}{R_1} \quad (12)$$

Therefore, the transistor $Q_2$ functions as a constant current source of the absorption type with the current expressed by the equation (12).

Since, however, a resistor of an IC is generally formed by the diffusion of impurity, the area of the resistor in the IC is in proportion to the resistance value thereof. In the case of the constant current circuit of FIG. 2, since the relation between the currents $I_1$ and $I_2$ is represented by the equation (11), if the current $I_2$ is selected, for example, 100 times of the current $I_1$, the resistor $R_2$ must be made to have the resistance value as 100 times as that of the resistor $R_3$. That is, the area of the resistor $R_3$ must be formed as 100 times as that of the resistor $R_2$. Thus, the IC becomes large in area and hence the circuit of FIG. 2 is unsuitable as an IC, too.

FIG. 3 shows a practical circuit which is formed by using the constant current circuit of FIG. 2 to derive six constant current outputs $I_2$ to $I_7$. If the circuit of FIG. 3 is formed as an IC, the area occupied by one transistor in the IC is approximately equal to the area of a resistor with the resistance value of 2 KΩ which is formed by the diffusion of impurity. Therefore, the constant current circuit of FIG. 3 satisfies following values.

$$112+1+1+1+4.8+17+33+100+2\times 6=281.8$$

$$281.8/2=140.9$$

That is, the circuit of FIG. 3 requires the area corresponding to a resistor of 281.8 KΩ or the area corresponding to 140.9 transistors.

OBJECTS AND SUMMARY OF THE INVENTION

Accordingly, an object of the present invention is to provide a novel constant current source.

Another object of the invention is to provide a constant current source small in occupying area even if the current ratio is large.

A further object of the invention is to provide a constant current source suitable to be formed as an IC.

According to an aspect of the present invention there is provided a constant current generating circuit which comprises:

(A) first, second, third and fourth transistors of one conductivity type each having base, emitter and collector electrodes;

(B) a voltage supply source having first and second voltage terminals;

(C) circuit means for connecting the collector and emitter electrodes of said first transistor to said first and second voltage terminals respectively with a first impedance means between the collector electrode and said first voltage terminal;

(D) circuit means for connecting the emitter electrode of said second transistor to said second voltage terminal through a second impedance;

(E) circuit means for connecting the emitter electrode of said third transistor to said second voltage terminal through a third impedance;

(F) circuit means for connecting the emitter electrode of said fourth transistor to said second voltage terminal;

(G) circuit means for connecting the base electrode of said first transistor to said emitter electrode of said second transistor;

(H) circuit means for connecting said collector electrode of said first transistor to the base electrodes of said second and third transistors respectively;

(I) circuit means for connecting said emitter electrode of said third transistor to the base electrode of said fourth transistor; and (J) current utilizing means connected between said first voltage terminal and at least one of the collector electrodes of said second, third and fourth transistors.

The other objects, features and advantages of the present invention will become apparent from the following description taken in conjunction with the accompanying drawings through which the like reference designate the same elements.

DESCRIPTION OF THE PREFERRED EMBODIMENTS

A first example of the constant current source according to the present invention will be now described with reference to FIG. 4. In this example, the collector of a transistor $Q_1$ is connected through a resistor $R_1$ to a power source terminal $T_1$ supplied with a voltage $+V_{CC}$ and the emitter thereof is grounded. Transistors $Q_2$ and $Q_3$ have the bases commonly connected to the collector of the transistor $Q_1$ and the emitters respectively grounded through a resistors $R_2$ and $R_3$. The emitter of the transistor $Q_2$ is also connected to the base of the transistor $Q_1$. The emitter of the transistor $Q_3$ is connected to the base of a transistor $Q_4$ which has the emitter grounded.

Figure 4:
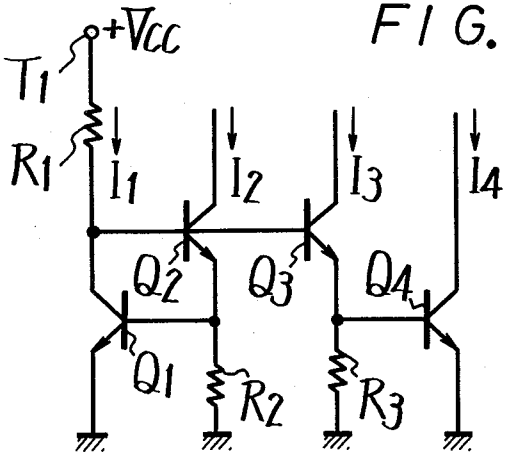
FIGS. 4 and 5 are respectively connection diagrams showing examples of the constant current source according to the present invention.

According to the circuit construction of FIG. 4, the following equation (13) is established on the bases of the transistors $Q_2$ and $Q_3$.

$$V_{BE1}+V_{BE2}=V_{BE3}+V_{BE4}$$

where $V_{BE3}$ is the base-emitter voltage $V_{BE}$ of the transistor $Q_3$; and $V_{BE4}$ is the base-emitter voltage $V_{BE}$ of the transistor $Q_4$.

From the equations (1) and (13), derived is the following equation (14).

$$I_1 \cdot I_2 = I_3 \cdot I_4 \tag{14}$$

where $I_3$ is the collector current of the transistor $Q_3$; and $I_4$ is the collector current of the transistor $Q_4$.

If the following conditions are satisfied for the sake of brevity, $$V_{BE1}=V_{BE2}=V_{BE3}=V_{BE4}=V_{BE}$$

the currents $I_1$, $I_2$ and $I_3$ can be respectively expressed as follows:

$$I_1 = \frac{V_{CC} - 2V_{BE}}{R_1} \tag{15}$$

$$I_2 = \frac{V_{BE}}{R_2} \tag{16}$$

$$I_3 = \frac{V_{BE}}{R_3} \tag{17}$$

From the equations (14) to (17), the current $I_4$ is expressed as follows:

$$I_4=(R_2/R_1)I_1 \quad (18)$$

As set forth above, the circuit of FIG. 4 can provide the constant currents $I_2$ to $I_4$ which are expressed by the equations (16) to (18), respectively. In the example of the invention shown in FIG. 4, all the transistors $Q_1$ to $Q_4$ can be made equal in the junction area, or no large junction area is required. Therefore, the constant current source shown in FIG. 4 is advantageous when it is made as an IC.

Figure 1:
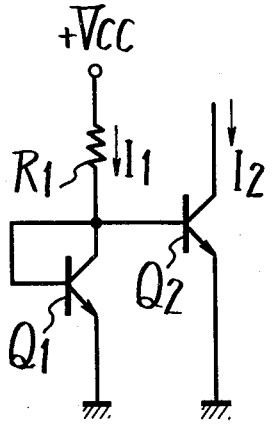
FIG. 1 (PRIOR ART)
FIGS. 1 to 3 are respectively connection diagrams showing prior art constant current circuits.
Figure 2:
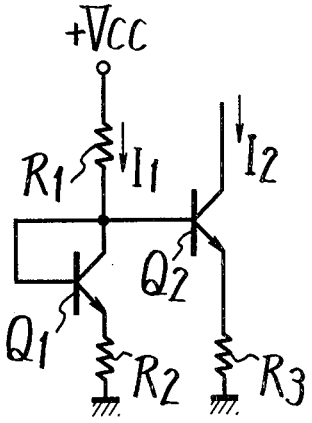
FIG. 2 (PRIOR ART)

In the case of the prior art circuit shown in FIG. 2, the following equation (19) is established.

$$R_1 + R_2 = \frac{V_{CC} - V_{BE1}}{I_1} \quad (19)$$

While, in the circuit of the invention shown in FIG. 4, the following equation (20) is derived from the equation (15).

$$R_1 = \frac{V_{CC} - 2V_{BE}}{I_1} \quad (20)$$

Thus, if the reference current $I_1$ is same through the circuits of FIGS. 2 and 4, the resistance value $R_1$ expressed by the equation (20) is smaller than the value $(R_1+R_2)$ expressed by the equation (19) by the amount corresponding to the voltage $V_{BE}$. As a result, the area occupied by the resistor $R_1$ (in FIG. 2, $R_1$ and $R_2$) which determines the current $I_1$ can be reduced, and hence the circuit of FIG. 4 is suitable to be made as an IC.

Figure 3:
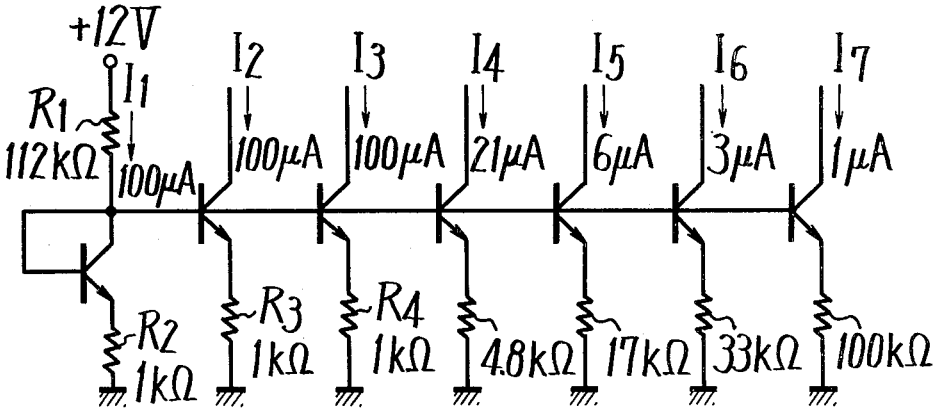
FIG. 3 (PRIOR ART)
Figure 5:
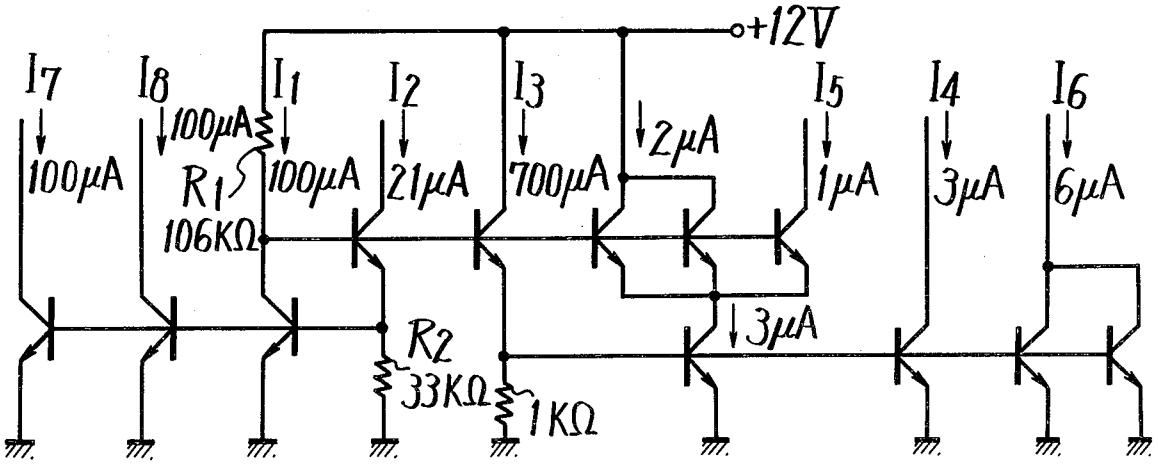

FIG. 5 shows a circuit which is made by using the circuit of FIG. 4 and produces constant current outputs similar to those of FIG. 3. In the circuit of FIG. 5, the following values are satisfied.

$$106+33+1+2\times 12=164\ (K\Omega)$$

$$164/2=82$$

Therefore, the circuit of FIG. 5 requires only the area corresponding to the resistor of 164 KΩ or 82 transistors in an IC. This value is 58% area of the circuit shown in FIG. 3. Therefore, the circuit of FIG. 5 is advantageous when it is made as an IC.

Further, when the output currents $I_2$ and $I_3$ of the circuit shown in FIG. 3 are compared with those $I_7$ and $I_8$ of the circuit shown in FIG. 5, the currents $I_2$ and $I_3$ of the circuit shown in FIG. 3 depend on four resistors $R_1$ to $R_4$, while the currents $I_7$ and $I_8$ of the circuit shown in FIG. 5 depend on only the resistor $R_1$. Therefore, the currents $I_7$ and $I_8$ are less scattered. Even if the currents $I_7$ and $I_8$ are scattered, the scattering direction thereof is equal. This means that the circuit of FIG. 5 is suitable to be made as an IC, too.

Though not shown, it may be possible to connect an emitter resistor to each of the transistors $Q_1$ and $Q_4$.

It will be apparent that many modifications and variations could be effected by one skilled in the art without departing from the spirits and scope of the novel concepts of the present invention so that the spirits and scope of the invention should be determined by the appended claim only.

We claim as our Invention:

1. A constant current generating circuit comprising:

(A) first, second, third and fourth transistors of one conductivity type each having base, emitter and collector electrodes;

(B) a voltage supply source having first and second voltage terminals;

(C) circuit means for connecting the collector and emitter electrodes of said first transistor to said first and second voltage terminals respectively with a first impedance means between the collector electrode and said first voltage terminal;

(D) circuit means for connecting the emitter electrode of said second transistor to said second voltage terminal through a second impedance;

(E) circuit means for connecting the emitter electrode of said third transistor to said second voltage terminal through a third impedance;

(F) circuit means for connecting the emitter electrode of said fourth transistor to said second voltage terminal;

(G) circuit means for connecting the base electrode of said first transistor to said emitter electrode of said second transistor;

(H) circuit means for connecting said collector electrode of said first transistor to the base electrodes of said second and third transistors respectively;

(I) circuit means for connecting said emitter electrode of said third transistor to the base electrode of said fourth transistor; and (J) current utilizing means connected between said first voltage terminal and at least one of the collector electrodes of said second, third and fourth transistors.

* * * * *